US011840811B1

(12) United States Patent
Wu et al.

(10) Patent No.: US 11,840,811 B1
(45) Date of Patent: Dec. 12, 2023

(54) STEEL-CONCRETE COMPOSITE BRIDGE DECK SLAB USING INVERTED U-SHAPED SHEAR CONNECTORS AND METHOD FOR CONSTRUCTING SAME

(71) Applicants: Fuzhou University, Fuzhou (CN); Fujian Expressway Technology Innovation Research Institute Co., Ltd., Fuzhou (CN)

(72) Inventors: Qingxiong Wu, Fuzhou (CN); Kangming Chen, Fuzhou (CN); Yilun Yang, Fuzhou (CN); Zhiwei Chen, Fuzhou (CN); Zuoxuan Sun, Fuzhou (CN)

(73) Assignees: Fuzhou University, Fuzhou (CN); Fujian Expressway Technology Innovation Research Institute Co., Ltd., Fuzhou (CN)

( * ) Notice: Subject to any disclaimer, the term of this patent is extended or adjusted under 35 U.S.C. 154(b) by 0 days.

(21) Appl. No.: 18/327,079

(22) Filed: Jun. 1, 2023

(30) Foreign Application Priority Data

Jun. 24, 2022 (CN) ..... 202210723291.1

(51) Int. Cl.
*E01D 19/12* (2006.01)
*E01D 101/26* (2006.01)

(52) U.S. Cl.
CPC ..... *E01D 19/125* (2013.01); *E01D 2101/268* (2013.01)

(58) Field of Classification Search
CPC . E01D 19/125; E01D 19/12; E01D 2101/268; E01D 19/00
See application file for complete search history.

(56) References Cited

U.S. PATENT DOCUMENTS 5,454,128 A * 10/1995 Kwon ..... E01D 19/125 404/47
6,871,462 B2 * 3/2005 Azizinamini ..... E04B 5/29 52/432
10,513,858 B2 * 12/2019 Do Carmo Pacheco . E04B 1/22
2006/0265819 A1 * 11/2006 Azizinamini ..... E01D 2/00 14/74.5
2007/0000077 A1 * 1/2007 Wilson ..... E01D 19/125 14/73

FOREIGN PATENT DOCUMENTS

CN 207331459 U 5/2018
CN 111879581 A 11/2020
CN 214328517 U 10/2021
CN 217896219 U 11/2022
CN 218643190 U 3/2023
JP 2010255196 A * 11/2010

* cited by examiner

*Primary Examiner* — Abigail A Risic

(57) ABSTRACT

A steel-concrete composite bridge deck slab using inverted U-shaped shear connectors and a method for constructing the same. The steel-concrete composite bridge deck slab includes a bottom steel plate and a bridge deck concrete layer, wherein inverted U-shaped perforated steel plate units are arranged on an upper surface of the bottom steel plate, and bar-mat reinforcements are arranged at upper ends of the inverted U-shaped perforated steel plate units.

9 Claims, 3 Drawing Sheets

STEEL-CONCRETE COMPOSITE BRIDGE DECK SLAB USING INVERTED U-SHAPED SHEAR CONNECTORS AND METHOD FOR CONSTRUCTING SAME

FIELD OF TECHNOLOGY

The present disclosure belongs to the technical field of bridge structures, and particularly relates to a steel-concrete composite bridge deck slab using inverted U-shaped shear connectors and a construction method.

BACKGROUND

A bridge deck slab, as an important component of a bridge structure, directly bears wheel pressures and impacts of vehicles on the bridge. Its working state will directly affect the service performance of the bridge. It is of great significance to correctly select a bridge deck slab structure in bridge design.

A steel-concrete composite bridge deck slab is a novel bridge deck slab formed by combining a steel bottom plate with upper concrete through shear connectors in various forms such as studs or perfobond rib shear connectors (PBLs) as a whole to carry load jointly. Under the action of a load, a combined advantage of high tensile property of steel and high compressive property of concrete can be exerted fully.

At present, in construction of the steel-concrete composite bridge deck slab, elastic connector such as dense shear studs or rigid connectors such as PBLs are combined with the studs, and even longitudinal reinforcing steel bars penetrate into holes of the PBLs to be connected to the dense studs in other regions, so as to improve the shear capacity of the overall steel-concrete composite bridge deck slab.

In the combined shear connectors, the perforated steel plate itself features high anti-sliding rigidity and high shear strength, and can enhance the connection of the bottom steel plate on the bridge deck and the transverse rigidity of the bridge deck. It is the novel steel-concrete composite bridge deck slab, which is innovation and development of a conventional reinforcing steel bar-concrete composite slab and is more suitable for being used as the bridge deck slab capable of bearing high load, complex loads and fatigue loading action.

However, as the dense shear studs are on the bridge deck, the construction working surface and the workload will be improved remarkably, and the welding quality of the studs is affected by various factors such as welding skill of technicians and welding devices. By using the shear connectors formed by combining the PBLs with the studs, can the shear design requirement be met still by a large quantity of studs.

By using the novel shear combined connectors of PBLs+studs+longitudinal reinforcing steel bars, the longitudinal reinforcing steel bars penetrate through holes of the perforated steel plate first, the shear sections of the reinforcing steel bars in the perforated section are very small, the reinforcing steel bars and the section of concrete in the holes form a bolt pin combination of reinforcing steel bars+concrete, and compared with a steel plate perforated full-concrete section bolt pin, the shear performance is improved to a small extent.

Second, the rigid PBLs are large in rigidity themselves and have a small contact area with bridge deck concrete, and cracks are likely to occur at the joining interface of steel and concrete. Finally, by using the novel shear combined connectors of PBLs+studs+longitudinal reinforcing steel bars, the shear design requirement can be met by means of joint shear resistance with the studs. The bridge deck structure is tedious in construction and large in construction working surface, the amount of steel used and the self weight of the bridge deck are increased, the economical benefit is low, the application of the structure in a larger-span bridge deck slab is restricted, and the structure is inconsistent with the development direction of a bridge deck system of the bridge which is durable, light and convenient to construct.

Therefore, it is necessary to design a structure form of a steel-concrete composite bridge deck slab structure which is reasonable in stress, light in self weight, excellent in durability, convenient to construct and high in economical practicality and a construction method therefor, which aims to solve problems that an existing steel-concrete composite bridge deck slab structure features complex structure and construction, large working surface, multiple diseases, low durability and the like.

A Chinese utility model with publication number CN214328517U and publication date Oct. 1, 2021 discloses a U-shaped connecting structure for a steel ingot milled steel fiber-concrete composite bridge deck slab, wherein an inverted U-shaped reinforcing rib is arranged on the surface of the bridge deck slab, and several through holes are formed in both sides of the reinforcing rib. An original rivet is replaced by the inverted U-shaped reinforcing rib with through holes, so that the contact areas among a steel plate, concrete and the reinforcing rib are increased. The formed through holes allow concrete to flow in, so that the reinforcing rib can be completely buried into the concrete.

However, the U-shaped reinforcing rib+reinforcing bar structure in the patent for invention is the above bolt pin combination of reinforcing steel bars+concrete. Compared with the steel plate perforated full-concrete section bolt pin, the shear performance is improved to a small extent, but the bridge weight is significantly increased, so that the construction tedious degree is increased.

SUMMARY

The present disclosure provides a steel-concrete composite bridge deck slab using inverted U-shaped shear connectors. By performing pouring on a bottom steel plate to form a bridge deck concrete layer and arranging inverted U-shaped perforated steel plate units on the bottom steel plate and arranging bar-mat reinforcements on the inverted U-shaped perforated steel plate units, the shear capacity of the steel-concrete composite bridge deck slab is further improved.

In addition, the present disclosure further provides a construction method for the composite bridge deck slab. The entire construction process of the composite bridge deck slab can be simply and efficiently completed by fixing the bottom steel plate first, then welding the inverted U-shaped perforated steel plate units and the bar-mat reinforcements and finally performing pouring to form the bridge deck concrete layer.

The technical solution used to solve the above problems is as follows: the steel-concrete composite bridge deck slab using inverted U-shaped shear connectors is used. The structure includes a bottom steel plate and a bridge deck concrete layer, wherein inverted U-shaped perforated steel plate units are arranged on an upper surface of the bottom steel plate, and bar-mat reinforcements are arranged at upper ends of the inverted U-shaped perforated steel plate units.

A further preferable technical solution is as follows: a length direction of each of the inverted U-shaped perforated steel plate units is a transverse bridge direction of the bridge deck slab, and two long edges of the inverted U-shaped perforated steel plate unit both are arranged on the upper surface of the bottom steel plate.

A further preferable technical solution is as follows: the inverted U-shaped perforated steel plate unit includes two inverted U-shaped steel plates with the long edges bending downwards, top openings formed in central axes in the long edge directions of the inverted U-shaped steel plates, and configured for forming concrete shear studs, and two rows of lateral openings respectively formed in two sides of the top openings, and configured for forming concrete shear studs.

A further preferable technical solution is as follows: the top openings and the lateral openings are elliptical, and a long axial direction of ellipse is a long edge direction of the inverted U-shaped steel plate.

A further preferable technical solution is as follows: the length of the short axis length of each of the lateral openings is greater than ½ of a height of the inverted U-shaped perforated steel plate unit; and the length of the short axis length of each of the top openings is greater than ½ of a width of the inverted U-shaped perforated steel plate unit.

A further preferable technical solution is as follows: the inverted U-shaped steel plate is further provided with a connecting frame unit for installing the bar-mat reinforcements.

A further preferable technical solution is as follows: the connecting frame unit includes a vertical rectangular plate, an arc-shaped groove formed in a bottom edge of the vertical rectangular plate, and configured for clipping the inverted U-shaped steel plate, and a half-sectional tube arranged on an upper surface of the vertical rectangular plate, and configured for installing a reinforcing steel bar below the bar-mat reinforcement.

A further preferable technical solution is as follows: the connecting frame unit further includes through holes formed between the arc-shaped groove and a vertical side surface of the vertical rectangular plate, and a splicing column formed in two of the through holes and penetrating through two of the lateral openings.

A further preferable technical solution is as follows: the connecting frame unit further includes two fastening nuts respectively arranged at two ends of the splicing column, and configured for clamping the vertical side surface of the vertical rectangular plate.

A method for constructing the steel-concrete composite bridge deck slab using inverted U-shaped shear connectors successively includes the following steps:

S1: fixing the bottom plate main beam of bridge steel;

S2: welding the two long edges of the inverted U-shaped perforated steel plate units to the upper surface of the bottom steel plate;

S3: welding the bar-mat reinforcements to the upper ends of the inverted U-shaped perforated steel plate units; and

S4: pouring bridge deck concrete onto the bottom steel plate, pouring and ramming the interior and exterior of the inverted U-shaped perforated steel plate unit compactly, then covering the bottom steel plate and performing maintenance till a designed strength is reached so as to finally form an intact bridge deck slab.

The present disclosure has the following advantages:

1. A large number of concrete shear studs with large sections are formed on the inverted U-shaped perforated steel plate unit of the bridge deck concrete layer, which significantly enhances the shear capacity of the bridge deck slab.
2. The whole bar-mat reinforcement is additionally arranged on the inverted U-shaped perforated steel plate unit to form an internal reinforcing steel bar "framework" of the bridge deck concrete layer, which further improves the structural integrity of the bridge deck slab.
3. A connecting frame unit is arranged between the inverted U-shaped perforated steel plate unit and the bar-mat reinforcement, which guarantees that the bar-mat reinforcement has a sufficient welding area and the bar-mat reinforcement is firmly welded to the inverted U-shaped perforated steel plate unit.
4. The connecting frame unit can further adjust the relative height of the bar-mat reinforcement relative to the bottom steel plate.
5. The connecting frame unit can further reinforce the inverted U-shaped perforated steel plate unit.
6. The construction method for the whole composite bridge deck slab is relatively simple and convenient. The steel structure and the concrete structure are constructed from bottom to top in sequence with reasonable and sequential construction operations.

Figure 1:
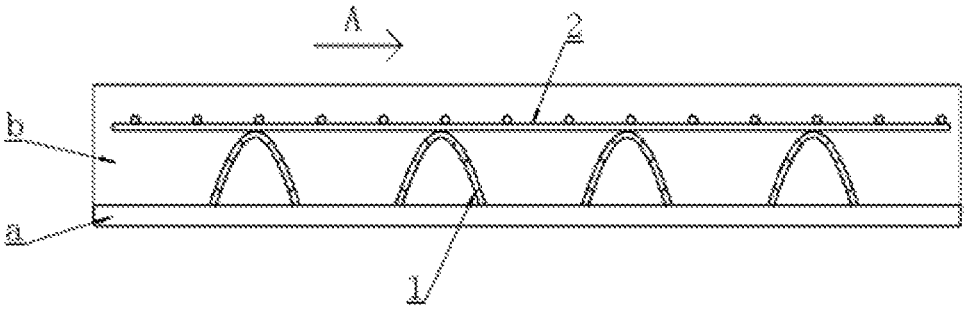
FIG. 1 is a schematic diagram of a sectional structure of the present disclosure in a longitudinal bridge direction.

In the drawings, reference numerals are listed as follows: A—longitudinal bridge direction—; a—bottom steel plate; b—bridge deck concrete layer; 1—inverted U-shaped perforated steel plate unit; 2—bar-mat reinforcement; 101—inverted U-shaped steel plate; 102—top opening; 103—lateral opening; 3—connecting frame unit; 301—vertical rectangular plate; 302—arc-shaped groove; 303—half-sectional tube; 304—through hole; 305—splicing column; 306—fastening nut.

DESCRIPTION OF THE EMBODIMENTS

The following is merely preferred embodiments of the present disclosure and is not limitation to the scope of the present disclosure.

Figure 2:
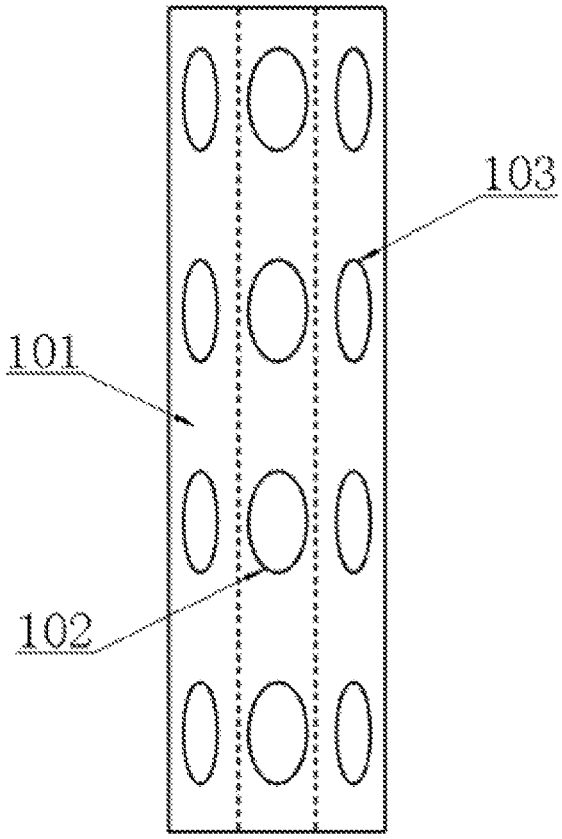
FIG. 2 is a structural schematic diagram of an inverted U-shaped perforated steel plate unit which is not bent.
Figure 3:
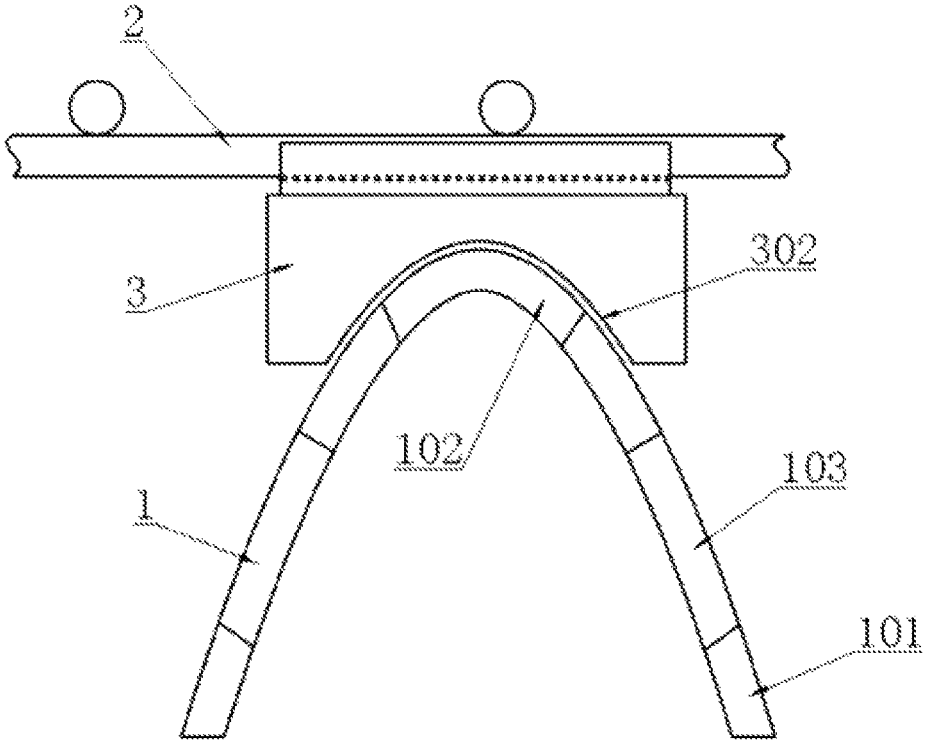
FIG. 3 is a schematic diagram of a position structure of a connecting frame unit in the present disclosure.
Figure 4:
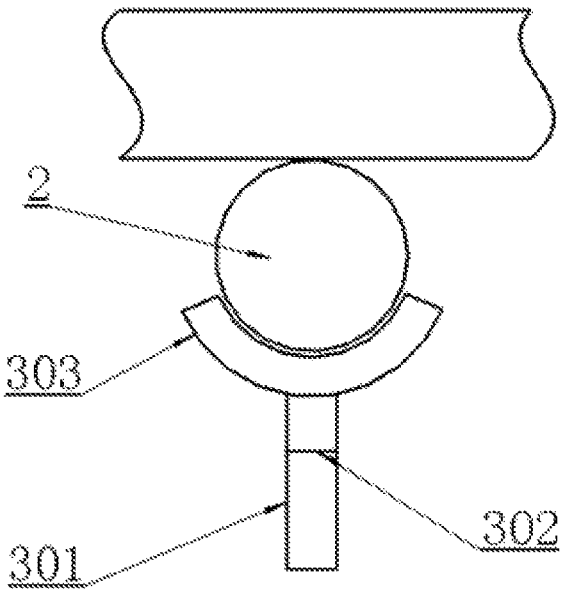
FIG. 4 is a schematic diagram of a usage mode of a half-sectional tube in the present disclosure.
Figure 5:
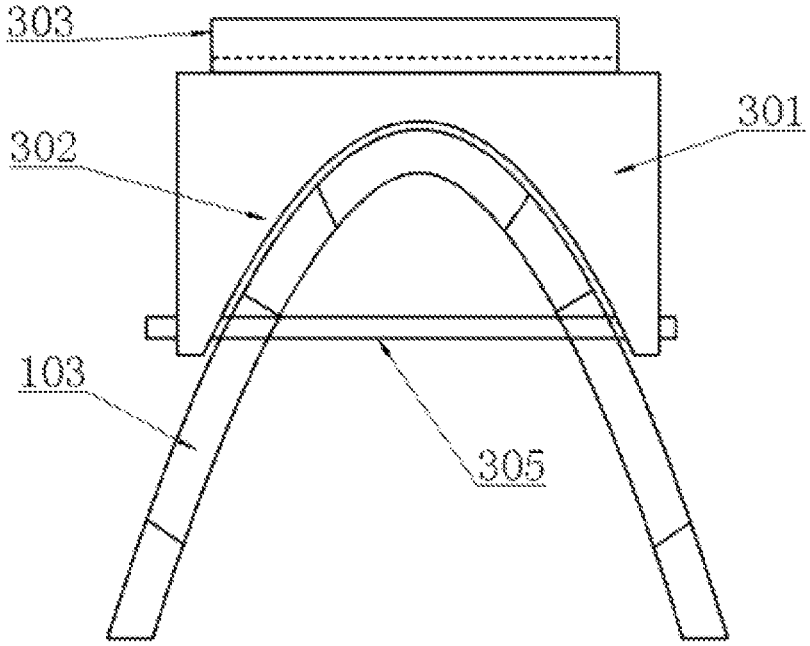
FIG. 5 is a schematic diagram of a position structure of a splicing column in the present disclosure.
Figure 6:
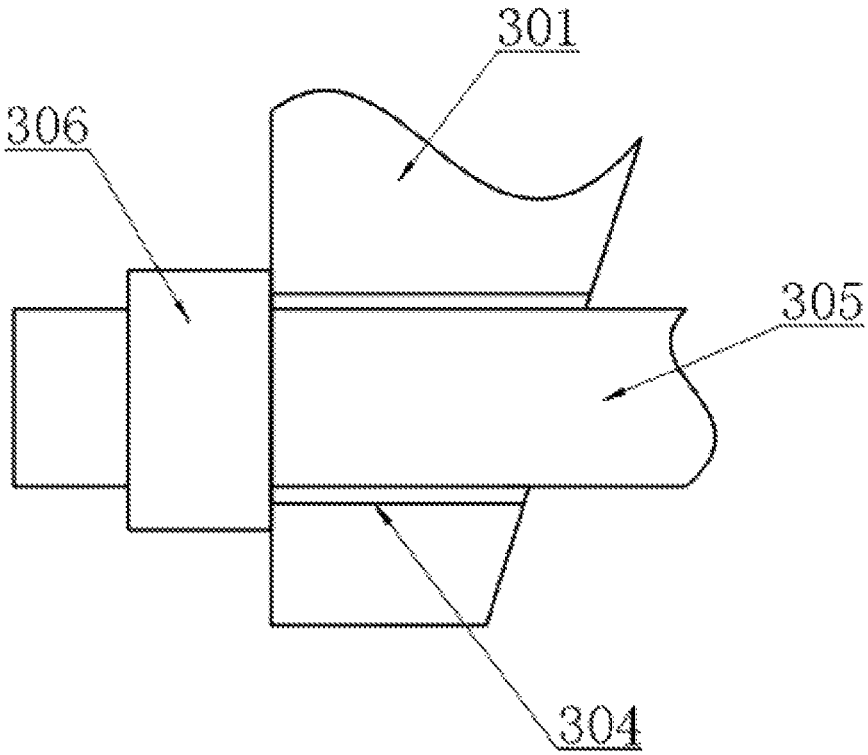
FIG. 6 is a schematic diagram of a position structure of a fastening nut in the present disclosure.

As shown in FIGS. 1-6, the steel-concrete composite bridge deck slab using inverted U-shaped shear connectors is adopted. The structure includes a bottom steel plate a and a bridge deck concrete layer b, wherein inverted U-shaped perforated steel plate units 1 are arranged on an upper surface of the bottom steel plate a, and bar-mat reinforcements 2 are arranged at upper ends of the inverted U-shaped perforated steel plate units 1.

In the embodiment, arrangement and extension directions of several inverted U-shaped perforated steel plate units 1 are the longitudinal bridge direction of the bridge deck slab, i.e., driving direction, and the inverted U-shaped perforated steel plate unit 1 itself is a large shear connector.

A length direction of each of the inverted U-shaped perforated steel plate units 1 is a transverse bridge direction of the bridge deck slab, and two long edges of the inverted U-shaped perforated steel plate unit 1 are arranged on the upper surface of the bottom steel plate a.

In the embodiment, the inverted U-shaped perforated steel plate unit 1 is welded to the upper surface of the bottom steel plate a. In addition, common shear studs can further be arranged on the upper surface of the bottom steel plate a.

The inverted U-shaped perforated steel plate unit 1 includes two inverted U-shaped steel plates 101 with the long edges bending downwards, top openings 102 formed in central axes in the long edge directions of the inverted U-shaped steel plates 101, and configured for forming concrete shear studs, and two rows of lateral openings 103 respectively formed in two sides of the top openings, and configured for forming concrete shear studs 102.

In the embodiment, the inverted U-shaped steel plate 101 is formed by bending a rectangular straight steel plate in an inverted U-shaped pattern. In addition, the top openings 102 and the lateral openings 103 are formed during formation of the rectangular straight steel plate.

The top openings 102 and the lateral openings 103 are elliptical, and a long axial direction of ellipse is a long edge direction of the inverted U-shaped steel plate 101.

In the embodiment, the top openings 102 and the lateral openings 103 cannot be polygonal such as rectangular and triangular, because the inverted U-shaped steel plate 101 is easy to crack at the angle ends of the openings as stress at the angle ends of polygon will be too concentrated. In addition, the top openings and the lateral openings are preferably round holes, so that the above problem of stress concentration can be alleviated properly. However, with respect to the strip-type inverted U-shaped steel plate 101, if the round holes are too small, the formed concrete shear studs are not large enough with ordinary shear performance, and if the round holes are too large, an under-width region is easily formed at the inverted U-shaped steel plate 101, and the region is easy to break as well.

Therefore, the top openings and the lateral openings are most preferably elliptical, which can alleviate the problem, that the lateral sides of the steel plate are too thin, brought by the round holes.

The length of the short axis length of each of the lateral openings 103 is greater than ½ of the height of the inverted U-shaped perforated steel plate unit 1; and the length of the short axis length of each of the top openings 102 is greater than ½ of the width of the inverted U-shaped perforated steel plate unit 1.

In the embodiment, the length of the short axis length of each of the lateral openings 103 and the length of the short axis length of each of the top openings 102 both are plane sizes of the steel plate which is not bent. The two elliptical holes are large to the greatest extent, so as to increase the dimensional specifications of the concrete shear studs formed at the lateral openings 103 and the top openings 102 to the greatest extent without obviously reducing the structural strength of the inverted U-shaped steel plate 101, thereby improving the shear performance of the whole composite bridge deck slab.

The inverted U-shaped steel plate 101 is further provided with a connecting frame unit 3 for installing the bar-mat reinforcements 2.

In the embodiment, there are at least the following two shortcomings in terms of using effect of the bar-mat reinforcements 2 if there is no connecting frame unit 3: I, there is a few region at the top of the inverted U-shaped steel plate 101 for welding the bar-mat reinforcements 2, so that the two are not firmly welded; and II, once the height of the inverted U-shaped steel plate 101 is fixed, the up-down heights of the bar-mat reinforcements 2 cannot be adjusted properly.

Thus, the connecting frame unit 3 is arranged just to solve the above two problems.

The connecting frame unit 3 includes a vertical rectangular plate 301, an arc-shaped groove 302 formed in a bottom edge of the vertical rectangular plate 301 to clip the inverted U-shaped steel plate 101, and a half-sectional tube 303 arranged on an upper surface of the vertical rectangular plate 301 to install a reinforcing steel bar below the bar-mat reinforcement 2.

In the embodiment, use of the connecting frame unit 3 has a requirement on the bar-mat reinforcement 2, i.e., the reinforcing steel bars below the bar-mat reinforcement 2 have to be perpendicular to the length direction of the inverted U-shaped steel plate 101.

Therefore, the arc-shaped groove 302 is welded to the upper surface of the inverted U-shaped steel plate 101, and the half-sectional tube 303 is welded to the reinforcing steel bars below the bar-mat reinforcement 2, guaranteeing that the two welds have welding faces large enough. Of course, at the beginning, the vertical rectangular plate 301 is integrally formed with the half-sectional tube 303 or has been firmly welded to the half-sectional tube.

Finally, above the inverted U-shaped steel plate 101, each reinforcing steel bar below the bar-mat reinforcement 2 needs not to be connected by the connecting frame unit 3 as long as the fixing strength of the bar-mat reinforcement 2 meets the design requirement.

The connecting frame unit 3 further includes through holes 304 formed between the arc-shaped groove 302 and a vertical side surface of the vertical rectangular plate 301, and a splicing column 305 formed in two of the through holes 304 and penetrating through two of the lateral openings 103.

In the embodiment, the splicing column 305 penetrates through the first through hole 304, the first lateral opening 103, the second lateral opening 103 and the second through hole 304 in sequence, guaranteeing that besides the above welding position, there is a clamping and fixing action at the splicing column 305 between the vertical rectangular plate 301 and the inverted U-shaped steel plate 101. Therefore, it is finally guaranteed that the connecting frame unit 3 is installed firmly on the inverted U-shaped steel plate 101.

Of course, it is to be noted that the splicing column 305 can neither be too thick nor reduce the dimensional specification of the concrete shear studs formed at the lateral openings 103.

The connecting frame unit 3 further includes two fastening nuts 306 respectively arranged at two ends of the splicing column 305 to clamp the vertical side surface of the vertical rectangular plate 301.

In the embodiment, threaded sections are further arranged at both ends of the splicing column 305 and are matched with the fastening nuts 306 to further fix the splicing column 305 firmly.

A method for constructing the steel-concrete composite bridge deck slab using inverted U-shaped shear connectors successively includes the following steps:

S1: fixing the bottom plate a on a main beam of bridge steel;

S2: welding the two long edges of the inverted U-shaped perforated steel plate units 1 to the upper surface of the bottom steel plate a;

S3: welding the bar-mat reinforcements 2 to the upper ends of the inverted U-shaped perforated steel plate units 1; and S4: pouring bridge deck concrete onto the bottom steel plate a, pouring and ramming the interior and exterior of the inverted U-shaped perforated steel plate unit 1 compactly, then covering the bottom steel plate and performing maintenance till a designed strength is reached so as to finally form an intact bridge deck slab.

In step S2 of the embodiment, common studs can further be welded to the upper surface of the bottom steel plate a at this time, and the common studs can further be located inside the inverted U-shaped perforated steel plate unit 1.

Eventually, the steel-concrete composite bridge deck slab features prominent shear performance Detailed description has been made on the embodiments of the present disclosure in combination of the accompanying draws above. But the present disclosure is not limited to the above-mentioned implementation modes. Those of ordinary skill further can make various modifications without departing from the concept of the present disclosure within their knowledge. These are modifications without inventiveness, and those in the scope of claims of the present disclosure are protected by patent law.

What is claimed is:

1. A steel-concrete composite bridge deck slab using inverted U-shaped shear connectors, comprising a bottom steel plate and a bridge deck concrete layer, wherein inverted U-shaped perforated steel plate units are arranged on an upper surface of the bottom steel plate, and bar-mat reinforcements are arranged at upper ends of the inverted U-shaped perforated steel plate units; and wherein the inverted U-shaped perforated steel plate unit comprises two inverted U-shaped steel plates with the long edges bending downwards, top openings formed in central axes in long edge directions of the inverted U-shaped steel plates, and configured for forming concrete shear studs, and two rows of lateral openings respectively formed in two sides of the top openings, and configured for forming concrete shear studs.

2. The steel-concrete composite bridge deck slab using inverted U-shaped shear connectors according to claim 1, wherein a length direction of each of the inverted U-shaped perforated steel plate units is a transverse bridge direction of the bridge deck slab, and two long edges of the inverted U-shaped perforated steel plate unit are arranged on the upper surface of the bottom steel plate.

3. The steel-concrete composite bridge deck slab using inverted U-shaped shear connectors according to claim 1, wherein the top openings and the lateral openings are elliptical, and a long axial direction of ellipse is a long edge direction of the inverted U-shaped steel plate.

4. The steel-concrete composite bridge deck slab using inverted U-shaped shear connectors according to claim 3, wherein a length of the short axis of each of the lateral openings is greater than ½ of a height of the inverted U-shaped perforated steel plate unit; and a length of the short axis of each of the top openings is greater than ½ of a width of the inverted U-shaped perforated steel plate unit.

5. The steel-concrete composite bridge deck slab using inverted U-shaped shear connectors according to claim 1, wherein the inverted U-shaped steel plate is further provided with a connecting frame unit for installing the bar-mat reinforcements.

6. The steel-concrete composite bridge deck slab using inverted U-shaped shear connectors according to claim 5, wherein the connecting frame unit comprises a vertical rectangular plate, an arc-shaped groove formed in a bottom edge of the vertical rectangular plate, and configured for clipping the inverted U-shaped steel plate, and a half-sectional tube arranged on an upper surface of the vertical rectangular plate, and configured for installing a reinforcing steel bar below the bar-mat reinforcement.

7. The steel-concrete composite bridge deck slab using inverted U-shaped shear connectors according to claim 6, wherein the connecting frame unit further comprises through holes formed between the arc-shaped groove and a vertical side surface of the vertical rectangular plate, and a splicing column formed in two of the through holes and penetrating through two of the lateral openings.

8. The steel-concrete composite bridge deck slab using inverted U-shaped shear connectors according to claim 7, wherein the connecting frame unit further comprises two fastening nuts respectively arranged at two ends of the splicing column, and configured for clamping the vertical side surface of the vertical rectangular plate.

9. A method for constructing the steel-concrete composite bridge deck slab using inverted U-shaped shear connectors according to claim 1, successively comprising the following steps:

(S1) fixing the bottom plate on a main beam of bridge steel;

(S2): welding the two long edges of the inverted U-shaped perforated steel plate units to the upper surface of the bottom steel plate;

(S3): welding the bar-mat reinforcements to the upper ends of the inverted U-shaped perforated steel plate units; and (S4): pouring bridge deck concrete onto the bottom steel plate, pouring and ramming an interior and exterior of the inverted U-shaped perforated steel plate unit compactly, then covering the bottom steel plate and performing maintenance till a designed strength is reached so as to finally form an intact bridge deck slab.

* * * * *